US005934213A

United States Patent [19]

Bastian et al.

[11] Patent Number: 5,934,213

[45] Date of Patent: Aug. 10, 1999

[54] PROCESS FOR ACCURATELY DETERMINING THE ZERO POINT OF THE NEEDLE OF THE SEWING MACHINE OF AN AUTOMATIC SEWING UNIT

[75] Inventors: Eduard Bastian; Wilfried Halfmann, both of Kaiserslautern; Bernd Maue, Kreimbach-Kaulbach, all of Germany

[73] Assignee: G.M. Pfaff Aktiengesellschaft, Kaiserslautern, Germany

[21] Appl. No.: 09/053,863

[22] Filed: Mar. 24, 1998

[30] Foreign Application Priority Data

Mar. 25, 1997 [DE] Germany ..... 197 12 421

[51] Int. Cl.[6] ..... D05B 21/00

[52] U.S. Cl. ..... 112/470.06; 112/470.18; 112/475.04; 112/475.19

[58] Field of Search ..... 112/470.06, 470.18, 112/470.14, 470.07, 470.09, 113, 275, 475.04, 475.05, 475.19, 102.5

[56] References Cited

FOREIGN PATENT DOCUMENTS 25 60 217 C2 4/1984 Germany .
36 26 761 C1 2/1988 Germany .
40 39 827 A1 6/1992 Germany .
42 34 968 C1 12/1993 Germany .

*Primary Examiner*—Peter Nerbun

[57] ABSTRACT

A process for accurately determining the needle zero point of the sewing machine (4) of an automatic sewing unit (1) in relation to a positioning opening (12) of a fabric holder (10). The fabric holder (10) is connected to two feed parts (13, 14) displaceable along a straight guide rail (15) via at least two connecting rods (7, 8) of a coordinate transmission (9), such that the displacement of the feed parts (13, 14) brings about corresponding X/Y movements of the fabric holder (10), and wherein the displacement of the feed parts (13, 14) along the guide rail (15) is performed by means of drives (16, 17), which can be actuated by means of an electronic control device (6) containing at least one memory (26). To determine the needle zero point very accurately in such an automatic sewing unit (1) without performing a complicated mechanical adjustment, only an approximate setting of the sensor-monitored zero position of the fabric holder (10) is performed at first, and then an electronic correction of this value is subsequently performed, wherein the correction values are stored in a memory (26) of the control device (6) and they are correspondingly taken into account during the subsequent sewing and embroidering processes.

6 Claims, 3 Drawing Sheets

PROCESS FOR ACCURATELY DETERMINING THE ZERO POINT OF THE NEEDLE OF THE SEWING MACHINE OF AN AUTOMATIC SEWING UNIT

FIELD OF THE INVENTION

The present invention pertains to a process for accurately determining the zero point of the needle of the sewing machine of an automatic sewing unit in relation to a positioning opening of a fabric holder. The present invention also pertains to a device for carrying out the process.

BACKGROUND OF THE INVENTION

In industrial sewing machines and industrial embroidering machines (hereinafter also called automatic sewing units for short), the fabric is usually held, e.g., during the sewing of pockets on shirts and pants, etc., by a fabric holder, which runs along the sewing pattern under the needle of the sewing machine corresponding to the data stored in a memory of an electronic control device.

To obtain a reproducible sewing pattern, the fabric holder and the needle must be assigned to one another in a fixed manner. To monitor and set this assignment, the fabric holder is displaced into a zero position monitored by sensors in prior-art automatic sewing units after switching on the supply voltage, and the fabric holder is then displaced from this zero position into the area of the needle of the sewing machine to carry out the sewing process. At the time of the first start-up or after repairs on the automatic sewing unit, etc., a highly accurate positioning (i.e., positioning to an accuracy of 0.1 mm) of the sensors must be performed, usually with the fabric holder in its zero position, which is associated with a time-consuming mechanical adjustment.

If the fabric holder subsequently moves to the mechanical needle zero point and the needle does not exactly fit into the positioning opening of the fabric holder, an additional adjustment of the sewing machine is performed in prior-art automatic sewing units by mechanically displacing the machine. This process is also extraordinarily time-consuming.

DE 42 34 968 C1 discloses an automatic sewing unit, in which the fabric holder is connected via at least two connecting rods of a coordinate transmission to two feed parts displaceably along a straight guide rail, such that the displacement of the feed parts brings about corresponding X/Y movements of the fabric holder. The displacement of the feed parts along the guide rails takes place by means of two drives, which can be energized by means of an electronic control device. This document offers no details concerning the accurate positioning of the fabric holder in its zero position or concerning a subsequent positioning of the fabric holder in relation to the needle (determination of the needle zero point).

DE 25 60 217 C2 discloses an automatic sewing machine with a fabric holder and a zero position circuit, which brings the fabric holder into a predetermined position in each of the two coordinate directions X and Y before a sewing process in a zero position cycle. The fabric holder is displaced by means of stepping motors.

Furthermore, DE 36 26 761 C1 discloses an arrangement comprising a sewing machine and a feed means with a fabric holder, in which a optoelectronic sensor means monitors the actual operating position.

Finally, DE 40 39 827 A1 discloses a device for the numeric-controlled setting of a tool (e.g., a fabric holder), which consists of at least two parts and whose size is variable.

SUMMARY AND OBJECTS OF THE INVENTION

The basic object of the present invention is to provide a process for determining the accurate zero point of the needle for an automatic sewing unit, as is disclosed in DE 42 34 968 C1, wherein complicated mechanical adjustments shall be eliminated. Furthermore, a device for carrying out the process shall be offered.

According to the invention, a process is provided for the accurate determination of the needle zero point of a sewing machine of an automatic sewing unit in relation to a positioning opening. The fabric holder is connected to two feed parts displaceable along a guide rail via at least two connecting rods of a coordinate transmission such that the displacement of the feed parts brings about corresponding X/Y movements of the fabric holder. The displacement of the feed parts along the guide rail is performed by means of drives which can be actuated by means of an electronic control device containing at least one memory. The fabric holder is first displaced from any starting position into a first, sensor-monitored zero position. The fabric holder is subsequently displaced from the sensor-monitored zero position into a second zero position (gauge zero position), in which the angular positions of the connecting rods of the coordinate transmission are checked by means of a gauge. In the case of a deviation of the angular position of the connecting rods from the angles preset by the gauge, the connecting rods are displaced until their angular positions agree with those of the gauge, wherein the necessary correction values are stored in the memory of the electronic control device. The fabric holder is subsequently moved to a predetermined needle zero point and the sewing machine and the fabric holder are optionally displaced in relation to one another until the needle of the sewing machine can be introduced into the positioning opening of the fabric holder. Taking into account the coordinates of the gauge zero point and of the needle zero point as well as the correction values stored in the memory, the accurate needle zero point is determined and is correspondingly taken into account during the subsequent sewing and/or embroidering processes.

To determine the corrected needle zero point, preferably only the fabric holder is displaced by actuating the drives until the needle of the sewing machine can be introduced into the positioning opening of the fabric holder. These correction values are also stored in the memory of the electronic control device and are correspondingly taken into account during subsequent sewing and/or embroidering processes.

When an auxiliary device is used, to which the fabric holder also moves, the accurate position in relation to the corrected needle zero point is taken into account preferably by determining corresponding correction values by displacing the fabric holder and storing he values in the memory. These correction values are later taken into account during the movement to the auxiliary devices.

According to another aspect of the invention, a device for carrying out the process is provided. The sensor-monitored zero position of the said fabric holder is monitored by means of two sensors arranged stationarily at the automatic sewing unit.

Stepping motors are preferably used as the drives for displacing the fabric holder.

The present invention is based essentially on the idea of first performing a very approximate setting of the sensor-monitored zero position (i.e., a position to the accuracy of a few mm) of the fabric holder and of subsequently performing an electronic correction of this value. The sensors may be arranged stationarily and nonadjustably at the automatic sewing unit, so that neither the sensors nor mechanical parts of the coordinate transmission need to be adjusted in a time-consuming manner, e.g., after a repair of the automatic sewing unit.

Based on the sensor-monitored zero position of the fabric holder, another reference point (gauge zero point) is reached to perform the electronic correction. The angular positions of the connecting rods of the coordinate transmission are checked by means of a mechanical zero point gauge (hereinafter called gauge for short).

If the angular positions of the connecting rods do not agree with the gauge, the connecting rods are moved by actuating the drives designed as stepping motors until their angular positions exactly correspond to those of the gauge. The corresponding correction values are stored in a memory of the control device. After determining the corrected gauge zero point, the position of the fabric holder in which the carriage guide is at an exactly defined distance from the fabric holder is known, without a complicated adjustment of the sensors and of the coordinate transmission being necessary, and the correction values stored in the memory will be taken into account correspondingly during the subsequent sewing and embroidering processes.

Based on the gauge zero point, the fabric holder moves to the predetermined mechanical needle zero point. If the needle does not exactly fit into the positioning opening of the fabric holder, a displacement of the fabric holder is preferably performed by correspondingly actuating the stepping motors, instead of a mechanical displacement of the sewing machine. These correction values are also stored in a memory of the control device. The position of the needle of the sewing machine is now accurately determined in relation to the fabric holder without complicated adjustment of the sewing machine, and the additional correction values stored in the memory are also taken into account correspondingly during the subsequent sewing and embroidering processes (i.e., the formula by means of which the usual Cartesian sewing pattern coordinates are converted into the motor coordinates (motor increments) is correspondingly corrected).

If the corresponding sewing or embroidering machine has auxiliary devices, such as a fabric feed means, a folding device, etc., to which the fabric holder moves, the position of this auxiliary device in relation to the fabric holder must be set as was described above in connection with the needle zero point.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
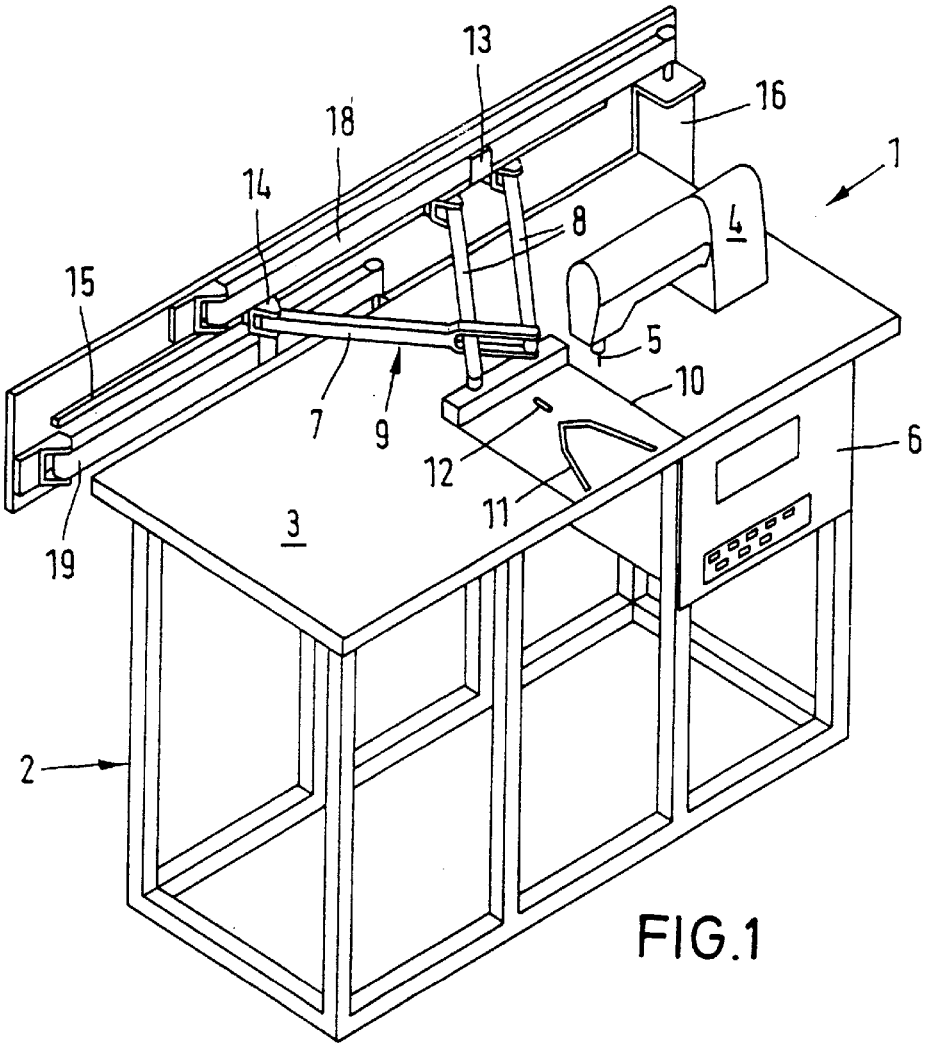
FIG. 1 is a perspective view of an automatic sewing unit with sewing machine and fabric holder, in which the process according to the present invention is used.

Referring to the drawings in particular, an automatic sewing unit as is described in DE 42 34 968 C1 in detail is designated by reference number 1 in FIG. 1. The automatic sewing unit comprises essentially a frame 2 with a support plate 3, on which a sewing machine 4 with a needle 5 is arranged. In addition, an electronic control device 6 is fastened to the frame 2. The automatic sewing unit 1 also comprises a coordinate transmission 9, which consists of a single and double connecting rod 7, 8 and is connected to a fabric holder 10. The fabric holder 10 is provided with both an elongated hole 11, which shows the contour of the sewing pattern to be prepared later, and a positioning opening 12 for the needle zero point determination to be explained later. The fabric holder 10 may first be in any position to the side of the sewing machine 4.

The coordinate transmission 9 can be displaced along a guide rail 15 extending in the horizontal direction by means of corresponding feed parts 13, 14 at the connecting rods 7, 8, and the two connecting rods 7, 8 can be displaced at different velocities. The coordinate transmission 9 is driven by means of two stepping motors 16, 17 (FIG. 2), which act on the feed parts 13, 14 via toothed belts 18, 19 (for the mode of action of the coordinate transmission, see specifically the above-mentioned DE 42 34 968 C1).

Figure 2:
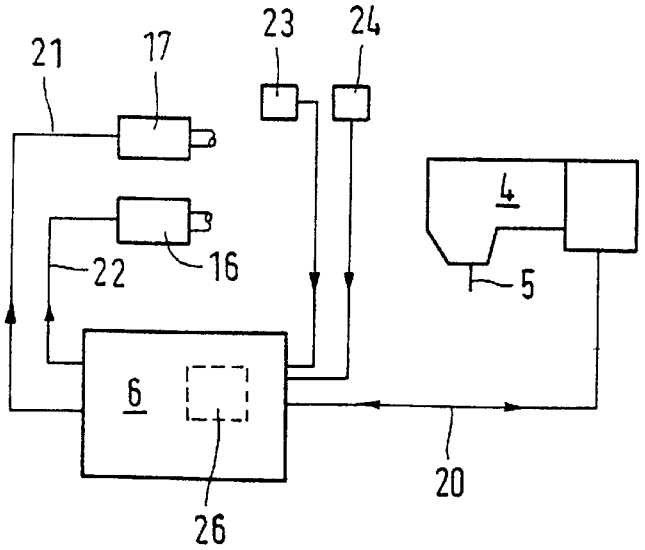
FIG. 2 is a block diagram of the device for carrying out the process.

The electronic control unit 6, which is connected via corresponding electric lines 20–22 to both the sewing machine 4 and the two stepping motors 16, 17, is schematically shown once again in FIG. 2.

Figure 3:
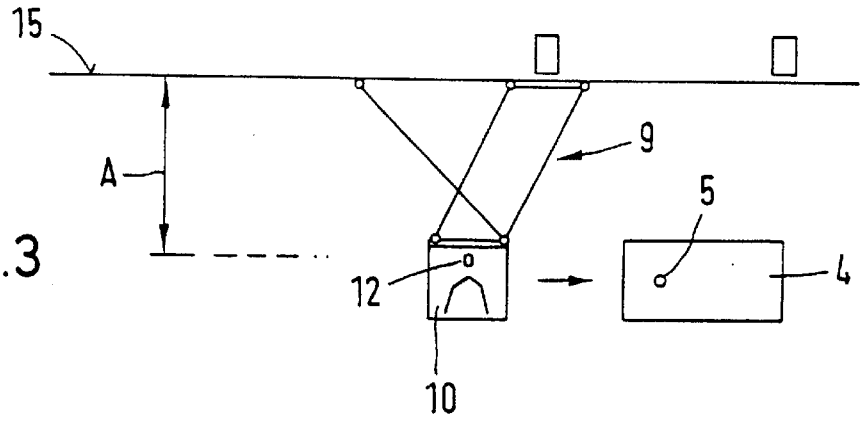
FIG. 3 is a schematic representation of the automatic sewing unit shown in FIG. 1, wherein the fabric holder assumes a position corresponding to an individual process step.

The process according to the present invention will be explained in greater detail below by means of FIGS. 3–8. FIG. 3 corresponds essentially to FIG. 1, i.e., the fabric holder 10 is in any position and is at a distance A from the guide rail 15.

Figure 4:
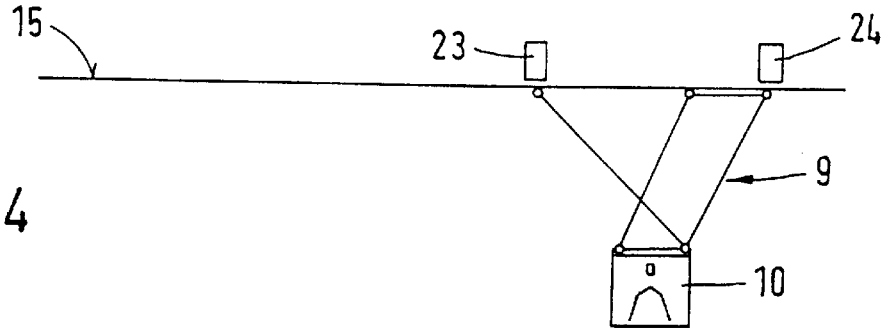
FIG. 4 is a schematic representation of the automatic sewing unit shown in FIG. 1, wherein the fabric holder assumes a position corresponding to an individual process step.
Figure 5:
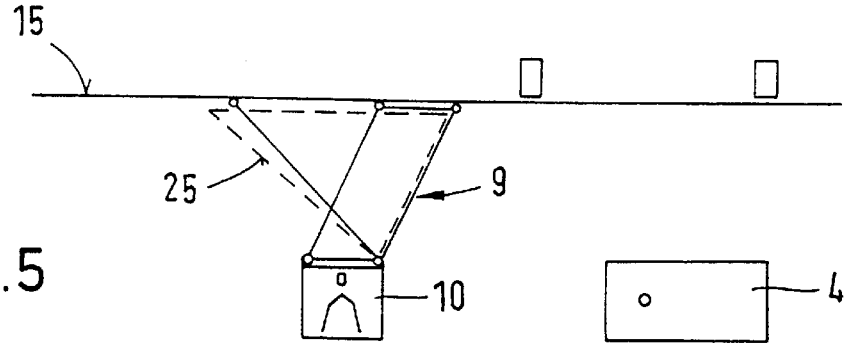
FIG. 5 is a schematic representation of the automatic sewing unit shown in FIG. 1, wherein the fabric holder assumes a position corresponding to an individual process step.

If the electronic control device 6 is now switched on, the stepping motors 16, 17 (FIG. 2) are activated, and the coordinate transmission 9 and thus also the fabric holder 10 are displaced along the guide rail 15 to the right into a zero position monitored by two sensors 23, 24 (FIG. 4).

Figure 6:
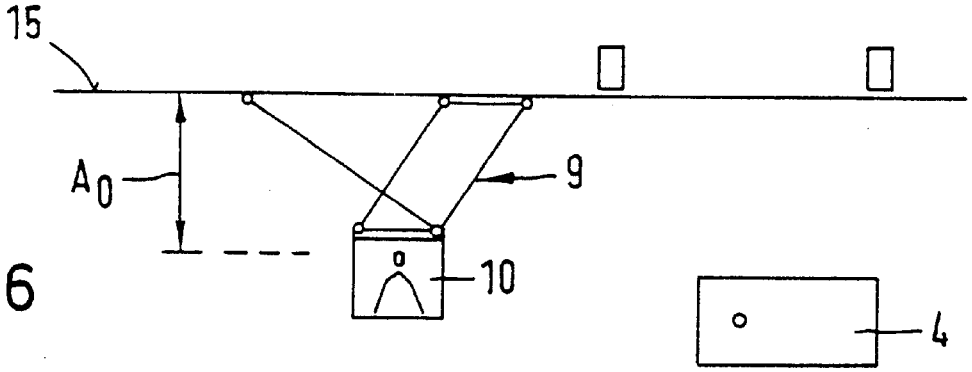
FIG. 6 is a schematic representation of the automatic sewing unit shown in FIG. 1, wherein the fabric holder assumes a position corresponding to an individual process step.

The fabric holder 10 is subsequently displaced by means of the stepping motors 16, 17 to the so-called gauge zero point (FIG. 5) over a section predetermined by the control device 6. The angular positions of the connecting rods 7, 8 of the coordinate transmission are checked in this position by means of a mechanical gauge 25 indicated by broken lines in FIG. 5. If the angular positions of the connecting rods 7, 8 do not agree with the gauge 25, the connecting rods are displaced by actuating the stepping motors 16, 17 until their angular positions exactly agree with those of the gauge (FIG. 6). The corresponding correction values are stored in a memory 26 (FIG. 2) of the control device 6. After determining the corrected gauge zero point, the correct distance $A_0$ between the guide rail 15 and the fabric holder 10 is known.

Figure 7:
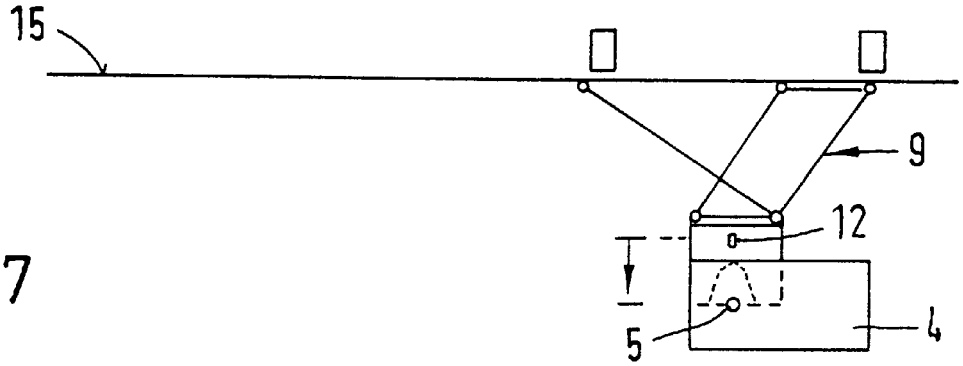
FIG. 7 is a schematic representation of the automatic sewing unit shown in FIG. 1, wherein the fabric holder assumes a position corresponding to an individual process step.
Figure 8:
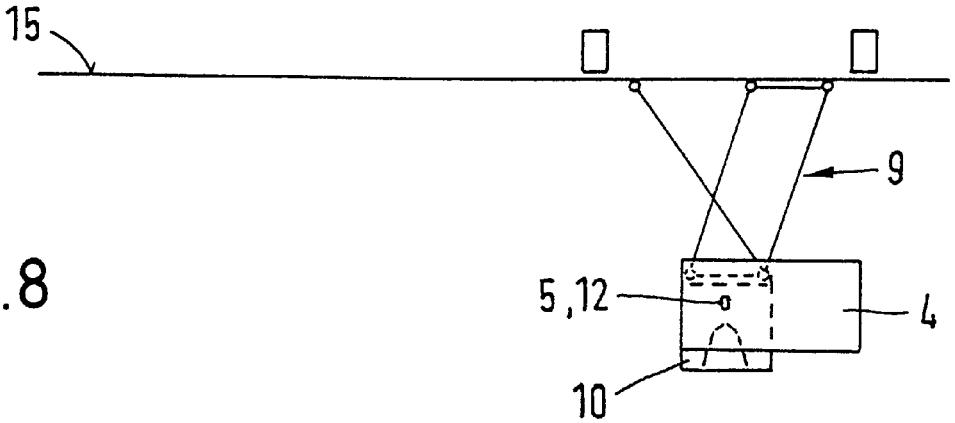
FIG. 8 is a schematic representation of the automatic sewing unit shown in FIG. 1, wherein the fabric holder assumes a position corresponding to an individual process step.

Finally, the fabric holder 10 moves to the (theoretical) needle zero point, which is likewise predetermined by the control device 6 (FIG. 7). If the needle 5 of the sewing machine 4 cannot be accurately introduced into the positioning opening 12 of the fabric holder 10 in this position of the fabric holder 10, a further correction of the fabric holder 10 is performed by correspondingly actuating the stepping motors 16, 17. These correction values are also stored in the memory 26 of the control device 6. A corrected needle zero point is thus obtained.

The position of the needle 5 of the sewing machine 4 in relation to the fabric holder 10 is now accurately determined, and the correction values being stored in the memory 26 will be taken into account correspondingly during the subsequent sewing and embroidering processes, i.e., a corresponding correction of the formula by means of which the usually Cartesian sewing pattern coordinates are converted into the motor increments is performed. As a result, not only is the corrected needle zero point or the machine zero point derived from it reached automatically, but the corresponding sewing pattern, which is in Cartesian coordinates, is also correctly converted into motor coordinates. Manufacturing tolerances are compensated as a result, and a distorted sewing pattern is avoided.

While specific embodiments of the invention have been shown and described in detail to illustrate the application of the principles of the invention, it will be understood that the invention may be embodied otherwise without departing from such principles.

What is claimed is:

1. A process for the accurate determination of the needle zero point of a sewing machine of an automatic sewing unit in relation to a positioning opening, the process comprising the steps of:

providing a fabric holder connected to two feed parts displaceable along a guide rail via at least two connecting rods of a coordinate transmission such that the displacement of the feed parts brings about corresponding X/Y movements of the fabric holder;

providing drives for the displacement of the feed parts along the guide rail, the drives being actuated by means of an electronic control device containing at least one memory;

displacing the fabric holder from any starting position into a first, sensor-monitored zero position;

subsequently displacing the fabric holder from the sensor-monitored zero position into a gauge zero position;

at said gauge zero position checking the angular positions of the connecting rods of the coordinate transmission by means of a gauge;

in the case of a deviation of the angular position of the connecting rods from angles preset by the gauge, displacing the connecting rods until angular positions of the connecting rods agree with angular positions of the gauge;

storing necessary correction values in the memory of the electronic control device;

subsequently moving the fabric holder to a predetermined needle zero point;

determining the accurate needle zero point by taking into account the coordinates of the gauge zero point as well as the correction values stored in the memory and taking into account the determined accurate needle zero point during the subsequent sewing and embroidering processes.

2. A process in accordance with claim 1, wherein during said step of moving the fabric holder to a predetermined needle zero point, if the needle cannot be introduced into the positioning opening, the sewing machine and the fabric holder are displaced in relation to one another at said predetermined needle zero point until the needle of the sewing machine can be introduced into the positioning opening to determine coordinates of a corrected needle zero point of the fabric holder and said step of determining the accurate needle zero point includes both said step of taking into account the coordinates of the gauge zero point and the coordinates of the corrected needle zero point as well as the correction values stored in the memory, the accurate needle zero point is determined and is correspondingly taken into account during the subsequent sewing and embroidering processes.

3. The process in accordance with claim 2, wherein to determine the corrected needle zero point, only the said fabric holder is displaced by actuating the drives until the needle of the sewing machine can be introduced into the positioning opening of the fabric holder to form correction values, wherein these correction values are also stored in the memory of the electronic control device and are correspondingly taken into account during the subsequent sewing and embroidering processes.

4. The process in accordance with claim 1, wherein an auxiliary device is used to which the fabric holder also moves, an accurate position in relation to the corrected needle zero point is taken into account by determining corresponding correction values by displacing the fabric holder and storing these correction values in the memory, and these correction values are later taken into account during the movement to the auxiliary devices.

5. A device for the accurate determination of the needle zero point of a sewing machine of an automatic sewing unit in relation to a positioning opening, the device comprising:

a fabric holder connected to two feed parts displaceable along a guide rail via at least two connecting rods of a coordinate transmission such that the displacement of the feed parts brings about corresponding X/Y movements of the fabric holder;

drives for the displacement of the feed parts along the guide rail;

an electronic control device containing at least one memory, said control device for actuating the drives for displacing the fabric holder from any starting position into a first, sensor-monitored zero position, subsequently displacing the fabric holder from the sensor-monitored zero position into a gauge zero position, at said gauge zero position checking the angular positions of the connecting rods of the coordinate transmission by means of a gauge, in the case of a deviation of the angular position of the connecting rods from the angles preset by the gauge, displacing the connecting rods until angular positions of the connecting rods agree with angular positions of the gauge, storing necessary correction values in the memory of the electronic control device, subsequently moving the fabric holder to a predetermined needle zero point, and determining the accurate needle zero point by taking into account the coordinates of the gauge zero point as well as the correction values stored in the memory and taking into account the determined accurate needle zero point during the subsequent sewing and embroidering processes; and sensors arranged stationarily at the automatic sewing unit, said sensors for monitoring the zero position of the said fabric holder.

6. The device in accordance with claim 5, wherein stepping motors are used as said drives for displacing the said fabric holder.

* * * * *